US007975864B2

(12) United States Patent
Druitt et al.

(10) Patent No.: US 7,975,864 B2
(45) **Date of Patent: *Jul. 12, 2011**

(54) LINERLESS BORE SEAL CLOSURE

(75) Inventors: Rodney Malcolm Druitt, Warwickshire (GB); David Edward Foster, Worcestershire (GB)

(73) Assignee: Closures and Packaging Services Limited, Guernsey (GB)

( * ) Notice: Subject to any disclaimer, the term of this patent is extended or adjusted under 35 U.S.C. 154(b) by 0 days.

This patent is subject to a terminal disclaimer.

(21) Appl. No.: 12/393,410

(22) Filed: Feb. 26, 2009

(65) Prior Publication Data

US 2009/0159555 A1 Jun. 25, 2009

Related U.S. Application Data

(63) Continuation of application No. 10/489,167, filed as application No. PCT/AU02/01236 on Sep. 10, 2002, now Pat. No. 7,503,468.

(30) Foreign Application Priority Data

Sep. 10, 2001 (AU) ..... PR7588

(51) Int. Cl.
*B65D 53/00* (2006.01)

(52) U.S. Cl. ..... 215/344; 215/341; 215/343; 215/345

(58) Field of Classification Search ..... 215/344, 215/343, 345, 252, 341
See application file for complete search history.

(56) References Cited

U.S. PATENT DOCUMENTS 3,494,496 A 2/1970 Livingstone
(Continued)

FOREIGN PATENT DOCUMENTS

CA 1 196 606 11/1985
(Continued)

OTHER PUBLICATIONS

German Opposition issued in German Application No. DE 102 97 200 B4 dated Dec. 15, 2010.
Evidence of prior use in Bosnia and Slovenia in 1999/2000.

*Primary Examiner* — Anthony Stashick
*Assistant Examiner* — Christopher B McKinley
(74) *Attorney, Agent, or Firm* — McDermott Will & Emery LLP

(57) ABSTRACT

A closure (10) that is suitable for attachment to a container (20) having an end portion defining an opening of the container. The closure (10) comprises a top portion (11) and a skirt portion (12) depending from the top portion. The closure (10) also has a sealing rib (14) having a first sealing portion (15) which is contiguous with the top portion (11). The first portion (15) has an inner surface made up of at least a first substantially cylindrical surface portion (17) lying radially inwardly of the first surface portion (17). The rib (14) further includes a second sealing portion (16) that is separated from the top portion (11) by the first portion (15) and which, prior to attachment of the closure to the container, extends inwardly to a free edge. The closure (10) further has a continuous nub member (28) extending downwardly and outwardly from the underside of the top portion (11) and positioned radially inwardly of the first sealing portion (15). On relative attachment of the closure to the container end portion, the nub member (28) seals with an inner surface of the container end portion and the sealing rib (14) seals with at least an outer surface of the container end portion.

14 Claims, 3 Drawing Sheets

U.S. PATENT DOCUMENTS

| | | | | | |
|---|---|---|---|---|---|
| 4,196,818 | A | * | 4/1980 | Brownbill | 215/252 |
| 4,210,251 | A | * | 7/1980 | Grussen | 215/329 |
| 4,220,250 | A | * | 9/1980 | Brownbill | 215/270 |
| 4,276,989 | A | * | 7/1981 | Hicks | 215/270 |
| 4,322,012 | A | | 3/1982 | Conti | |
| 4,461,392 | A | * | 7/1984 | Conti | 215/270 |
| 4,560,077 | A | * | 12/1985 | Dutt | 215/307 |
| 4,566,603 | A | | 1/1986 | Moore | |
| 4,739,893 | A | * | 4/1988 | Zumbuhl | 215/344 |
| 5,275,287 | A | * | 1/1994 | Thompson | 215/344 |
| 5,423,444 | A | * | 6/1995 | Druitt | 215/344 |
| 5,439,126 | A | * | 8/1995 | Brownbill | 215/344 |
| 5,489,036 | A | * | 2/1996 | Arkins | 215/343 |
| 5,609,235 | A | | 3/1997 | Schwarzli | |
| 5,609,263 | A | * | 3/1997 | Perchepied | 215/252 |
| 5,638,972 | A | * | 6/1997 | Druitt | 215/344 |
| 5,676,269 | A | * | 10/1997 | Blake et al. | 215/252 |
| 5,743,420 | A | * | 4/1998 | Loffler et al. | 215/270 |
| 5,785,196 | A | | 7/1998 | Montgomery | |
| 5,836,464 | A | * | 11/1998 | Druitt | 215/344 |
| 6,126,027 | A | * | 10/2000 | Thompson | 215/354 |
| 6,260,721 | B1 | * | 7/2001 | Ohmi et al. | 215/256 |
| 6,325,228 | B1 | * | 12/2001 | Druitt | 215/344 |
| 6,382,445 | B1 | * | 5/2002 | McCandless | 215/341 |
| 6,527,132 | B1 | * | 3/2003 | Druitt et al. | 215/341 |
| 6,805,252 | B2 | * | 10/2004 | Druitt | 215/344 |
| 6,874,648 | B2 | * | 4/2005 | Willingham et al. | 215/344 |
| 7,469,795 | B2 | * | 12/2008 | Druitt et al. | 215/235 |
| 7,503,468 | B2 | * | 3/2009 | Druitt et al. | 222/344 |
| 2002/0030031 | A1 | * | 3/2002 | Druitt et al. | 215/252 |
| 2003/0057175 | A1 | * | 3/2003 | Willingham et al. | 215/344 |
| 2003/0116523 | A1 | * | 6/2003 | Druitt et al. | 215/341 |
| 2004/0060893 | A1 | * | 4/2004 | Kano et al. | 215/344 |

FOREIGN PATENT DOCUMENTS

| | | | |
|---|---|---|---|
| DE | 31 39 526 | A1 | 4/1983 |
| DE | 42 03 238 | A1 | 8/1993 |
| EP | 1 216 930 | A1 | 6/2002 |
| EP | 1 216 930 | B1 | 5/2004 |
| GB | 2 120 219 | A | 9/1983 |
| GB | 2 120 219 | A | 11/1983 |
| WO | WO 99/03746 | | 1/1999 |
| WO | WO 99/44896 | | 9/1999 |
| WO | WO 00/56615 | | 9/2000 |

* cited by examiner

LINERLESS BORE SEAL CLOSURE

RELATED APPLICATIONS

This application is a Continuation of U.S. application Ser. No. 10/489,167 filed Mar. 10, 2004, now U.S. Pat. No. 7,503,468 which is a U.S. National Phase under 35 U.S.C. §371 of International Application No. PCT/AU02/01236, filed Sep. 10, 2002, claiming priority of Australian Application No. PR7588, filed Sep. 10, 2001, the entire contents of each of which are hereby incorporated by reference.

TECHNICAL FIELD

The present invention relates to linerless closures for containers including, but not limited to, containers for carbonated beverages. More particularly, the invention relates to such closures that are formed of a synthetic plastics material and, preferably, molded in one piece for use in sealing reusable containers.

BACKGROUND ART

U.S. Pat. No. 5,423,444 discloses a plastics closure for a container having an externally screw threaded neck, the closure including a top portion and an internally threaded skirt. The closure has an annular sealing rib which projects downwardly from the underside of the top portion. The rib includes a first substantially cylindrical portion contiguous with the underside of the top portion and lying adjacent to or abutting with the skirt, and a second, frusto-conical, portion contiguous with the end of the first portion distal to the underside of the top portion and extending radially inwardly to a circular free edge. During threaded attachment of the closure with the neck, the second, frusto-conical, portion is engaged by a free end of the neck and folded back toward or against the first, substantially cylindrical portion of the rib to form a gas tight seal between at least the outer surface of the neck of the container and the closure.

U.S. Pat. No. 5,609,263 discloses a variant of the above closure in which there is at the free end of the second portion of the rib a thick seal ring of substantially circular cross-sectional shape. The rib and the seal ring are dimensioned to engage the free end of the neck when the closure is threaded onto the neck such that when the neck is fully screwed into the closure its free end crushes the seal ring directly against the inside surface of the top portion of the closure.

International Patent Application No PCT/AU98/00510 (WO 99/03746) discloses still further variants of the closure described in U.S. Pat. No. 5,423,444. In one variant, the sealing rib of the closure has a third portion connected to the second portion at or adjacent its circular edge and extending generally in a direction away from the top portion. The third portion is substantially no thicker than the second portion and has a length longer than its thickness. On attachment of this closure to a container, the third portion is positioned between the neck of the container and the underside of the top portion of the closure.

The present invention is further directed to a sealing rib arrangement for closures. In particular, the sealing rib arrangement finds use in circumstances where the container neck has suffered damage prior to application thereto of the closure. Such damage can arise in situations where the container is a reusable container and as such has been used at least once before.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

DISCLOSURE OF THE INVENTION

Throughout this specification, including the claims, the word "comprise" and variants such as "comprises" and "comprising" are used in a non-exclusive sense.

The present invention relates to a closure for a container, a container/closure combination, a method of forming the closure, a mold for use in making the closure, and a method of capping a container with the closure.

In the present specification, the closure is defined as being suitable for attachment to an end portion of the container. The end portion of the container to be sealed by the present invention preferably has a free end, an outside, preferably cylindrical, surface and an inside, preferably cylindrical, surface, the inside surface defining a bore. The join between the free end and the inside surface and the join between the free end and the outside surface are each preferably smoothly curved and define respectively what are hereinafter called the inner and outer sealing radii of the end portion of the container. It will be appreciated that the end portion of the container could be formed without either the inner or outer sealing radii or both.

According to one aspect, the present invention is a closure suitable for attachment to a container having an end portion defining an opening of the container, the closure comprising:

a top portion;

a skirt portion depending from the top portion, said top portion and skirt portion defining a cavity;

a first sealing portion which is at least adjacent the top portion and having an inner surface; and a second sealing portion separated from the top portion by the inner surface of the first portion;

said second sealing portion, prior to attachment of the closure to the container, extending at least inwardly into said cavity to a free edge positioned inwardly of the skirt portion, and the inner surface having a first substantially cylindrical surface portion lying radially inwardly of the skirt portion and at least a second substantially cylindrical surface portion lying radially inwardly of the first surface portion.

In one embodiment, the first surface portion is cylindrical. In another embodiment, the second surface portion is cylindrical. In a still further embodiment, both the first and second surface portions are cylindrical.

In another embodiment, the first surface portion is preferably closer to the top portion of the closure than the second surface portion. In one embodiment, the first surface portion can be contiguous with the underside of the top portion.

In one embodiment, the transition between the inner diameter of the first surface portion and the smaller inner diameter of the second surface portion of the inner surface of the closure is relatively abrupt. In another embodiment, the transition between the inner diameter of the first surface portion and the second surface portion is relatively gradual. In the latter case, the inner surface can have a transition surface between the first surface and the second surface. The transition surface can be substantially frusto-conical and is, more preferably, frusto-conical.

In a preferred embodiment, the closure further comprises an annular sealing rib. The annular sealing rib preferably includes the first sealing portion defined above. In a further embodiment, the first sealing portion of the sealing rib can be contiguous with the top portion and project downwardly from an underside of the top portion.

In a still further embodiment, the sealing rib can also include the second portion defined above. In this embodiment, the second portion is preferably contiguous with the first portion. More preferably, the second portion is contiguous with an end of the first portion distal the top portion. The second portion can extend for a length inwardly and downwardly from the distal end of the first portion to a circular free edge. In one embodiment, the second portion can be at least substantially frusto-conical, and, more preferably, frusto-conical, for at least a portion of its length.

The second sealing portion preferably is molded at an angle of between about 25° and 75° relative to a notional plane extending at a right angle to the skirt portion of the closure. The angle is more preferably between about 40° and 50° relative to the notional plane and most preferably about 44.5° relative to the notional plane.

In one embodiment, the second portion can firstly extend both inwardly and downwardly from the distal end of the first portion and then extend just downwardly for a length to the free edge. In another embodiment, the second portion can be non-linear. In this regard, the second portion can be partially or continuously curved.

In a preferred embodiment, the length of the second portion is such that, during attachment of the closure with the end portion of the container, the end portion of the container contacts the second portion and pushes it upwardly and preferably at least towards the first sealing portion of the closure.

More preferably, the internal diameter of at least the second surface portion of the inner surface of the closure relative to the external diameter of the end portion of the container is such that the second sealing portion, on attachment of the closure, is folded back against the second surface portion of the inner surface. In this embodiment, a seal is at least formed between the closure and at least the outer surface of the end portion of the container at a position away from the free end of the container end portion.

The radially inward position of the second surface portion of the inner surface serves to increase the force of the pressure of the sealing rib against the outside surface of the end portion of the container at a region distal the free end of the end portion on attachment of the closure to the end portion.

In a further embodiment, the underside of the top portion of the closure can have a nub extending downwardly from the underside of the top portion and positioned radially inwardly of the inner surface of the first sealing portion of the closure. The nub is preferably positioned such that, during relative attachment of the closure with the end portion of the container, the nub contacts the inner surface of the end portion of the container.

In a preferred embodiment, the nub comprises a continuous member having an inner surface, an outer surface, and an end distal the top portion. The nub preferably extends downwardly and outwardly from the top portion. The nub is preferably substantially frusto-conical. In another embodiment, the inner and outer surface are non-parallel but remain a substantially constant distance apart for at least a portion of the length of the nub extending downwardly from the top portion.

The outer surface of the nub preferably includes a contact surface that extends upwardly from the distal end of the nub for a portion of the outer surface. The contact surface contacts the inner surface of the container end portion. The contact surface is defined by an end region of the nub where it tapers in width towards its distal end. The contact surface is preferably curved and seals with the inner surface of the container end portion at a region distal the free end of the end portion of the container.

The nub preferably extends downwardly from the top portion for a length substantially equal to the length of the inner surface of the first sealing portion. In a still further embodiment, the thickness of the top portion of the closure between the outer surface of the nub and the inner surface of the first sealing portion can be greater than the thickness of the top portion inwardly of the nub.

The closure is preferably provided with a screw thread on an inside surface of the skirt portion that is engageable with a corresponding thread on an external surface of the end portion of the container. It is, however, possible for the container and the closure to be formed with other complementary attachment arrangements. Such an arrangement could, for instance, comprise a snap-on attachment arrangement having a rib on the inside surface of the closure and a corresponding groove on the outside surface of the end portion of the container.

The first sealing portion can comprise a thickening of the skirt portion in the region adjacent the top portion and, more preferably, in the region adjacent it connection to the top portion. By comprising such a thickening, the root of the second sealing portion, when contiguous with the first sealing portion, is moved inwardly of the part of the skirt portion having the screw thread or other attachment arrangement.

In another embodiment, the first sealing portion is formed radially inwardly of the skirt portion with an annular space therebetween. In a still further embodiment, the first sealing portion can be in abutment with the skirt portion over all or a portion of its length.

According to a second aspect, the present invention is a closure suitable for attachment to a container having an end portion defining an opening of the container, the closure comprising:

a top portion;

a skirt portion depending from the top portion, said top portion and skirt portion defining a cavity;

an annular sealing rib having, prior to attachment of the closure to the container, at least a portion extending inwardly into said cavity to a free edge; and a continuous nub member extending downwardly and outwardly from the underside of the top portion and positioned radially inwardly of the sealing rib, wherein on relative attachment of the closure to the container end portion, the nub member seals with an inner surface of the container end portion and the annular sealing rib seals with at least an outer surface of the container end portion.

In this second aspect, the outer surface of the nub preferably includes a contact surface that extends upwardly from an end of the nub distal the top portion for a portion of the outer surface. The contact surface can contact the inner surface of the container end portion. The contact surface is preferably defined by an end region of the nub where it tapers in width towards its distal end. The contact surface is preferably curved and seals with the inner surface of the container end portion at a region distal the free end of the end portion.

In the second aspect, the sealing rib can have a first sealing portion and a second sealing portion as defined above with respect to the preferred features of the first aspect of the present application.

In the second aspect, the nub preferably extends downwardly from the top portion a length substantially equal to the length of the inner surface of the first sealing portion of the closure. In a still further embodiment of the second aspect, the thickness of the top portion of the closure between the outer surface of the nub and the inner surface of the first sealing portion can be greater than the thickness of the top portion inwardly of the nub.

According to a third aspect, the present invention is a closure suitable for attachment to a container having an end portion defining an opening of the container, the closure comprising:

a top portion;

a skirt portion depending from the top portion, said top portion and skirt portion defining a cavity;

a sealing rib having:

a first sealing portion which is at least adjacent the top portion and having an inner surface, said inner surface having a first substantially cylindrical surface portion lying radially inwardly of the skirt portion and at least a second substantially cylindrical surface portion lying radially inwardly of the first surface portion; and a second sealing portion, separated from the top portion by the inner surface of the first portion and having, prior to attachment of the closure to the container, at least a portion extending inwardly into said cavity to a free edge; and a continuous nub member extending downwardly and outwardly from the underside of the top portion and positioned radially inwardly of the first sealing portion;

wherein on relative attachment of the closure to the container end portion, the nub member seals with an inner surface of the container end portion and the sealing rib seals with at least an outer surface of the container end portion.

In a preferred embodiment of the third aspect, the length of the second sealing portion of the sealing rib is such that, during attachment of the closure with the end portion of the container, the end portion of the container contacts the second portion and folds it at least towards the inner surface of the first sealing portion. More preferably, the internal diameter of the inner surface of the closure relative to the external diameter of the end portion of the container is such that, the second portion, on attachment of the closure, is folded back against the inner surface. In this embodiment, a seal is at least formed between the sealing rib and the outside surface of the end portion of the container.

In the third aspect, the sealing rib can have the features as defined above with respect to the preferred features of the first aspect of the present application.

The closures as defined above may be molded from a synthetic plastics material. It is preferred that the closure is formed from a suitable grade of polyethylene or polypropylene. It is also preferred to form the closure in one piece. The closures could, however, be formed in two or more parts with at least the sealing rib and/or the nub formed separately from the top portion and the skirt portion.

It will be apparent to persons skilled in the art that numerous modifications may be made to the closures described in this specification without departing from the scope of the invention as earlier defined. The closure may, for instance, be provided with a tamper evident band that provides an indication of removal or attempted removal of the closure from a container. The tamper evident band can be attached to the skirt portion by a frangible connection or region, such as a plurality of frangible bridges.

As is described in Australian Patent No 668197, the contents whereof are incorporated herein by reference, the band can also comprise a generally cylindrical body portion and a segmented rib extending inwardly of the body portion that provides a lip having an inner free edge to engage under a retaining flange extending outwardly from the end portion of the container. The combined length of the segmented ribs can be equal to at least 50% of the internal circumference of the band and the segmented ribs are preferably separated from each other by a gap. Each of the rib segments can each have an upper surface facing generally towards the top portion of the closure and an underside facing generally away from the top portion, with the inner surface of the band having a plurality of radially inward projections extending from above the free edge of the band and not extending beyond the inner free edge of the lip.

As is described in Australian Patent No 683598, the contents whereof are incorporated herein by reference, the upper surface of each rib segment extending inwardly of the body portion can be a compound surface and comprise a first surface contiguous with the body portion of the band, which surface has a slope that slopes inwardly and downwardly away from the top portion, and a second surface which extends radially inwardly from the inner terminus of the first surface and has a slope angle substantially normal, and preferably normal, to the skirt portion of the closure.

As is described in U.S. Pat. No. 5,676,269, the contents whereof are incorporated herein by reference, the tamper evident band can be joined to the skirt portion of the closure by a plurality of frangible bridges and at least one non-frangible bridge. The band can further have a substantially L-shaped slot extending through the side wall of the band, the horizontal leg of which terminates directly adjacent to or under the non-frangible bridge, and a weakened frangible region extending from the terminating end of the horizontal leg axially downwardly to the bottom of the band distal the frangible bridges.

As is described in U.S. Pat. No. 5,782,369, the contents whereof are incorporated herein by reference, the upper surface of the second portion of the sealing rib can have, at or adjacent its free end, engagement ridges that engage with the underside of the upper surface of the closure on sealing of the closure to an end portion of a container. The engagement ridges can comprise one or more ridges that frictionally engage with the underside of the top portion of the closure. The ridges on the upper surface of the second portion of the rib can engage with complementary ridges formed on the underside of the top portion of the closure, on sealing of the closure to a container.

Where the closure has a screw thread on the inner surface of the skirt portion, the thread can be continuous or formed of a series of thread segments. If formed from a series of thread segments, the thread segments can be arranged, starting from a first thread segment distal to the top, along a helical thread locus, as is described in Australian Patent No 668197. Each of the thread segments except the first can be formed with two substantially planar end surfaces that are inclined to the axis of the closure and face away from the top of the closure, that is they face in the direction that a mold core used to mold the closure was withdrawn. In this specification, the term "substantially planar surface" is used to describe a surface that is nearly actually planar or that is curved provided that it all faces in the defined direction. The first of the thread segments is preferably pointed at its end distal to its one adjacent thread segment to assist in mating the thread on the closure with a complementary thread on the end portion of a container.

The substantially planar ends of the thread segments can also be inclined to a notional radial plane of the closure extending from the longitudinal axis of the closure to the end of the respective thread segment such that the ends are inclined to the cylindrical skirt by an angle that is less than the angle that the respective notional plane makes with that skirt.

To assist in the venting of any gas that may be present in the container, the spaces between the thread segments in adjacent turns of the thread can be aligned. A groove may also be provided on the inside surface of the skirt portion of the closure extending longitudinally thereof through the aligned spaces.

There also can be at the line of meeting of the first and second portions of the sealing rib, a weakened zone or annular region of weakness to assist even deformation of the second portion relative to the first as the closure is attached to a container as is described in Australian Patent No 637706, the contents whereof are incorporated herein by reference.

In a further aspect, the present invention comprises a container having an end portion defining an opening of the container, the end portion being sealed by a closure as defined herein.

In this further aspect, the container can be a container for a carbonated beverage, a gaseous beverage, or a still beverage. The container can be formed from polyethylene terephthalate (PET) or co-polymers thereof.

In a still further aspect, the present invention comprises a mold for forming a closure as defined herein. The mold can be used to form the closure using injection, rotary or compression moulding. The mold preferably has a cavity that defines one or more of the features of the closure as defined above. It will be appreciated by persons skilled in the art that other suitable techniques for forming the closure could also be utilised.

In yet a further aspect, the present invention comprises a method of applying a closure as defined herein to an end portion of a container, the method comprising the step of turning the closure onto the end portion of the container until the closure seals the container.

BRIEF DESCRIPTION OF THE DRAWINGS

The following description of a preferred embodiment of the present invention is provided as an example of the invention and is described with reference to the accompanying drawings, in which:—

BEST MODE FOR CARRYING OUT THE INVENTION

Figure 2:
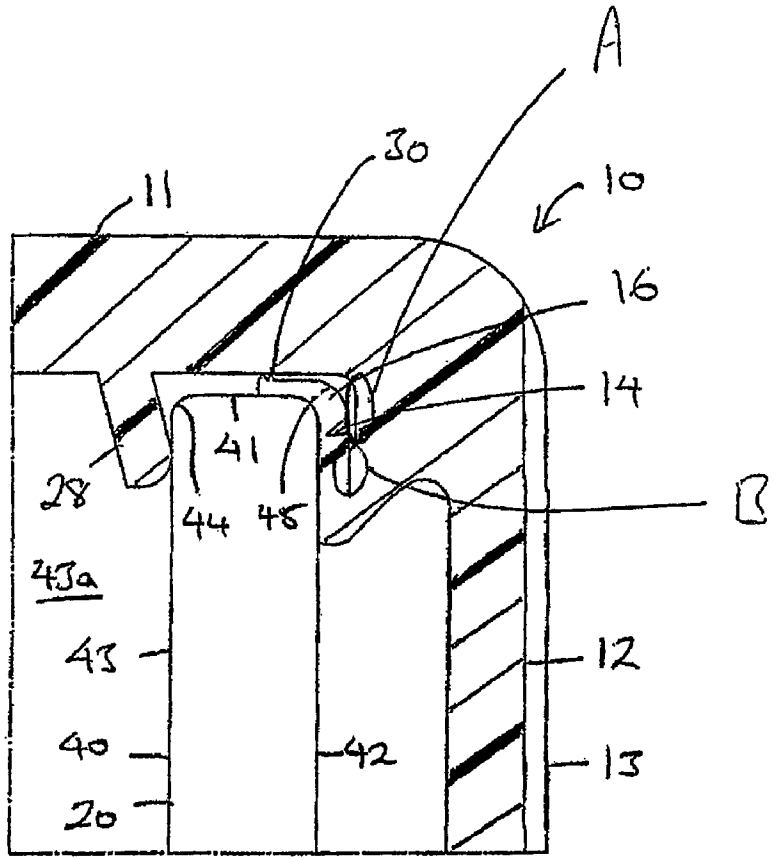
FIG. 2 is a simplified diametrical sectional view through the part of the closure depicted in FIG. 1 depicting the action of the sealing rib on attachment of the closure to an end portion of a container.
Figure 1:
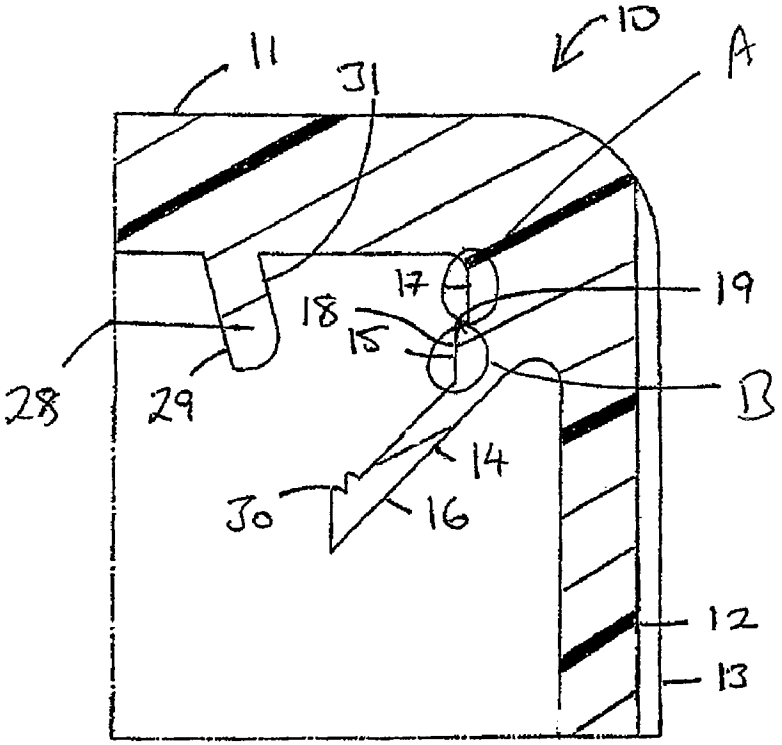
FIG. 1 is a simplified diametrical sectional view through a part of a closure according to one aspect of the present invention.

One embodiment of a closure according to the present invention is depicted generally as 10 in FIGS. 1 and 2.

The closure 10 shown in FIG. 1 is moulded from a synthetic plastics material in a suitable mold. Such a mold has cavity defining the features of the depicted closure. The closure 10 comprises a circular top 11 and a depending skirt 12. The radially inner surface of the skirt 12 is provided with a screw thread that mates with a corresponding thread on the neck of a bottle 20 to which the closure 10 is attached. While the embodiment of the closure 10 depicted in the drawings is described herein as having a screw thread, other suitable mating arrangements between the closure to the bottle 20 would be immediately apparent to a person skilled in the art.

The radially outer surface of the depicted skirt 12 carries a series of fine vertical ribs 13. The fine ribs 13 in the depicted embodiment terminate at the lower edge of the skirt 12 in a narrow circumferential rib.

Figure 3:
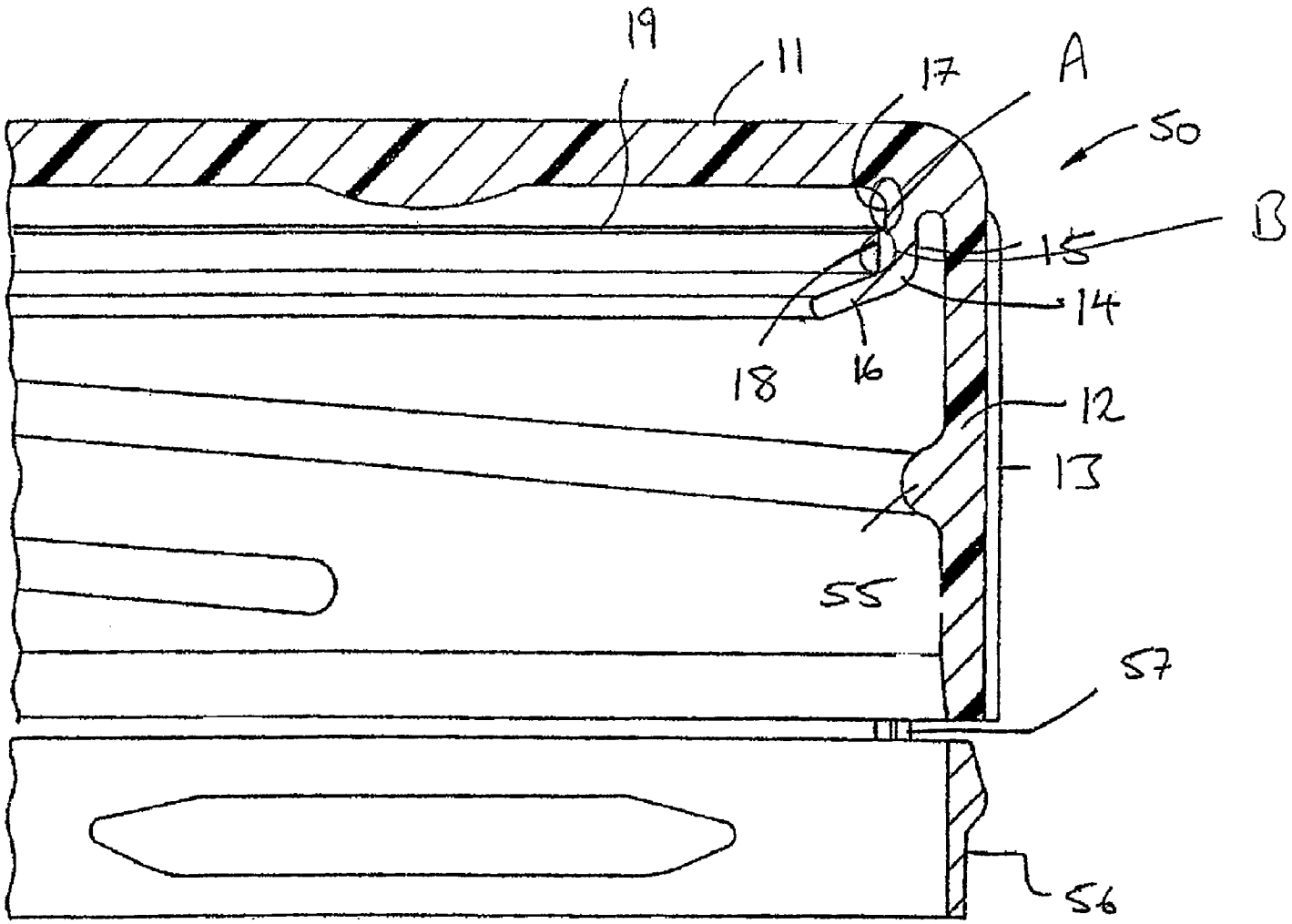
FIG. 3 is a partial view of an alternative embodiment of a closure according to the present invention.
Figure 4:
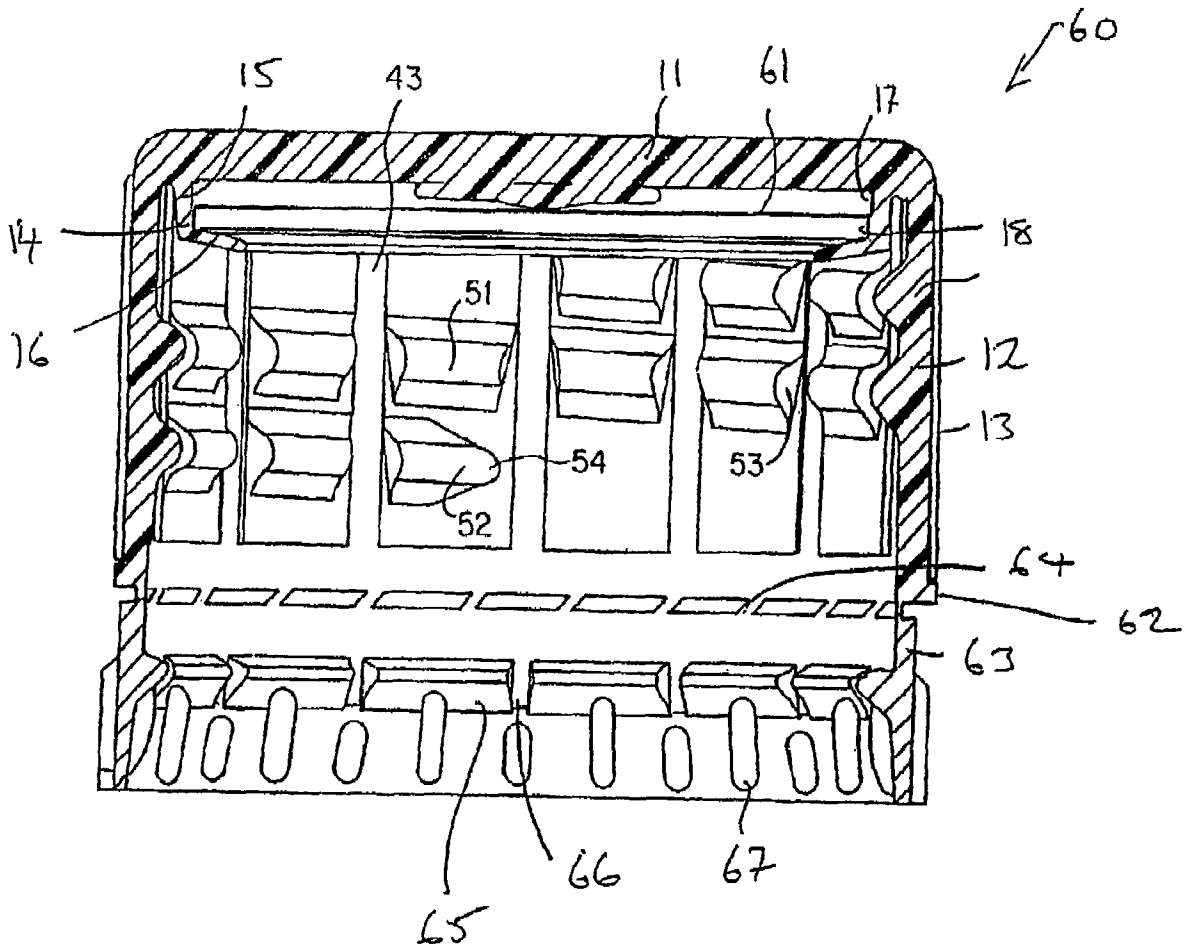
FIG. 4 is a cross-sectional view of a closure showing one possible arrangement of the thread on the skirt of the closure and the tamper evident band.

A sealing rib 14 is provided on the underside of the top 11 of the closure 10. The rib 14 is continuous and annular. Seen in cross-section, the rib 14 has two portions 15 and 16. The first portion 15 is contiguous with the top 11 and, in the depicted embodiment, comprises a thickening of the skirt 12 adjacent the top 11. It will be appreciated that the first portion 15 could be formed radially inward of the skirt 12 such that there is an annular space therebetween, as is depicted in FIGS. 3 and 4. It is also conceivable that the first portion could be molded such that it was in abutment with the skirt 12 for all or some portion of its length.

The inner surface of the first portion 15 has a first substantially cylindrical surface portion 17 and a second substantially cylindrical surface portion 18. As depicted, the second surface portion 18 is disposed radially inwardly of the first surface portion 17. The inner surface has an intermediate, substantially frusto-conical, region 19 where the thickness of the first portion 15 gradually increases in thickness. While a relatively gradual transition is depicted between the surface portions 17 and 18, a relatively abrupt transition could also be provided (as is depicted in FIG. 4).

The second portion 16 of the rib 14 is frusto-conical in form and is of substantially constant thickness as it extends radially downwardly and inwardly from its outer edge which is contiguous with the lower end of the first portion 15. While depicted as being of substantially constant thickness, it will be envisaged that the second portion 16 can taper slightly in thickness as it extends radially inwardly from its outer edge. As depicted, the upper surface of the second portion 16 can have a series of ridges 30. As depicted in FIG. 2, the ridges 30 can engage with the underside of the top 11 of the closure 10 on sealing of the closure 10 to the end portion of the container 20.

A relatively sharp edge can be formed at the line of meeting between the first portion 15 and the second portion 16. The sharp edge can be used to define a line of relative weakness between the two portions for a purpose that will be described later in this specification.

The underside of top 11 of the closure 10 depicted in FIGS. 1 and 2 has a nub 28 extending downwardly and outwardly from the underside of the top 11. The nub 28 is positioned radially inwardly of the sealing rib 14. The depicted nub 28 is continuous and has an inner surface 29 and an outer surface 31. The nub 28 extends downwardly from the top 11 for a length substantially equal to the length of the inner surface of the first portion 15 of the sealing rib 14.

The thickness of the top 11 of the closure 10 between the outer surface 31 of the nub 28 and the inner surface of the first portion 15 of the sealing rib 14 is the same as the thickness of the top 11 inwardly of the inner surface 29 of the nub 28. In another embodiment, the thickness of the respective regions of the top 11 could vary relative to one another.

The bottle 20 to be sealed by the closure 10 has a neck having an end portion 40. In the depicted embodiment, the bottle 20 is a returnable polyethylene terephthalate (PET) bottle. Such bottles typically have a thicker end portion 40 than non-returnable PET bottles of similar capacity. The end portion 40 has a free end 41, an outside cylindrical surface 42 and an inside cylindrical surface 43, with the inside surface 43 defining a bore 43*a*. The join between the free end 41 and the inside surface 43 and the join between the free end 41 and the outside surface 42, on the bottle 20 are each smoothly curved and define, respectively, inner and outer sealing radii 44,45 of the end portion 40 of the bottle 20. While the present closure 10 can seal bottles 20 having the depicted end portion 40, it will be readily appreciated that the closure 10 can seal bottles having different end portion configurations, eg. no outer and no inner sealing radii, or only one of the outer or inner sealing radii.

When the closure 10 is applied to and turned onto the end portion 40 of a bottle 20, the free end 41 of the end portion 40 engages the sealing rib 14 and starts to push the second portion 16 relatively upwardly within the closure 10. As the second portion 16 is pushed upwardly it bends relative to the first portion 15 along the line of weakness. This ensures that the folding of the second portion 16 relative to the first portion 15 takes place generally evenly around the whole circumference of the rib 14. As the closure 10 continues to be turned onto the bottle 20, the second portion 16 is folded back towards the inner surface of the first portion 15. At about this time, the nub 28 also starts to abut the inside surface 43 of the end portion 40.

Once the closure 10 is fully turned onto the end portion 40, the sealing rib 14 is positioned between the end portion 40 and the underside of the top 11 of the closure 10. As depicted, the second portion 16 has been folded, in this case, back into contact with the second cylindrical surface portion 18 of the first portion 15. The second portion 16, while folded back against the surface 18, also bears against the outside surface 42 and onto the outer sealing radius 45 of the end portion 40.

With the closure 10 fully engaged on the bottle 20, the nub 28 also exerts an outwardly directed pressure on the inside surface of the end portion 40. Once the closure 10 is fully turned onto the end portion 40, a seal is formed between the nub 28 and the inside surface 43 of the end portion 40. A seal is also formed between the rib 14 and the end portion 40. In the depicted embodiment, the seal extends from the outside surface 42 up around the outer sealing radius 45. Depending on the capping torque, the seal may also extend across the free end 41 for a distance, such as is depicted in FIG. 2.

It will be appreciated that the degree of sealing engagement of the second portion 16 with the free end 41 of the end portion 40 will depend on a number of factors, including the relative length of the first and second portions, the wall thickness of the end portion 40, and the capping torque used to turn the closure 10 onto the end portion 40.

FIG. 3 depicts an alternative embodiment of the closure according to the present invention. This embodiment is identified by numeral 50. Closure 50 is similar to the closure depicted in FIGS. 1 and 2 but does have a number of key differences. Firstly, it will be noted that closure 50 is not depicted as having a nub. While not depicted in FIG. 3, the closure 50 could be modified to include a nub, such as nub 28 of FIGS. 1 and 2. Further, the first sealing portion 15 of the sealing rib 14 is spaced inwardly from the skirt 12.

Closure 50 is also depicted as having a screw thread 55, and a tamper evident band 56 connected to the distal edge of the skirt 12 by a number of frangible bridges 57.

FIG. 4 depicts a still further embodiment of the closure depicted in FIG. 3. This closure is depicted generally as 60.

In this embodiment, the inner surface of the first portion is comprised of inner surfaces 17 and 18. These surfaces are separated by an abrupt transition 61. Again, the first portion 15 of the sealing rib 14 is spaced inwardly from the skirt 12.

The internal wall of the skirt 12 has a thread made up of a series of thread segments 51 arranged in spaced apart array along the locus of the thread. Each thread segment, except the first segment 52, is bounded at each end by a planar surface 53. Each of the planar surfaces 53 is inclined to the longitudinal axis of the closure 60 so that it faces away from the top 11. Each planar surface 53 is also inclined relative to a notional radial plane extending from the axis of the closure 60 to the planar surface 53 in question.

The first thread segment 52 is formed with a planar surface 53 on its trailing edge but is formed with a pointed leading edge 54 to assist in mating the thread on the closure 60 with a corresponding thread on the end portion of the neck of a container.

The thread segments 51 in each turn of the thread are aligned as are the spaces between them. A groove 43 is formed on the inside surface of the skirt 12 in each of the aligned spaces between adjacent thread segments 51. The grooves 43 serve to assist in venting gas from a beverage container as the closure 60 is unscrewed.

The skirt 12 of closure 60 terminates at its lowest edge in a circumferential rib 62. Below the rib 62, a tamper evident band 63 is joined to the skirt 12 by a plurality of frangible bridges 64. The inner surface of the band 63 has a rib made up of a series of rib segments 65 that extend inwardly and provide a lip having an inner free edge to engage under a retaining flange extending outwardly from the end portion of the container. The combined length of the rib segments 65 is greater than 50% of the internal circumference of the band 63 and the rib segments are separated from each other by a gap 66. Each of the rib segments 65 have an upper surface facing generally towards the top 11 and an underside facing generally away from the top 11. The inner surface of the band 63 also has a plurality of radially inward projections 67 extending from above the free edge of the band and not extending beyond the inner free edge of the lip.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A closure suitable for attachment to a container having an end portion defining an opening of the container, the closure comprising:

a top portion;

a skirt portion depending from the top portion, said top portion and skirt portion defining a cavity;

a first sealing portion which is at least adjacent the top portion and having an inner surface, said inner surface having a first substantially cylindrical surface portion that is substantially parallel (in cross-section) to and lying radially inwardly of the skirt portion and at least one second substantially cylindrical surface portion lying radially inwardly of and parallel (in cross-section) with the first surface portion, said second substantially cylindrical surface portion being spaced from the top portion by the first substantially cylindrical surface portion; and a second sealing portion separated from the top portion by the inner surface of the first sealing portion and having an inner surface and an outer surface with the inner surface tangential to an innermost second substantially cylindrical surface portion of said one or more substantially cylindrical surface portions;

wherein said second sealing portion, prior to attachment of the closure to the container, extends at least inwardly into said cavity to a free edge positioned inwardly of the skirt portion, and after attachment of the closure to the container, has been pushed relatively upwardly so that said inner surface of said sealing portion is brought into contact with at least the innermost of said second substantially cylindrical surface portions.

2. The closure of claim 1 wherein the transition between the inner diameter of the first surface portion and the smaller inner diameter of the second surface portion of the inner surface of the closure is substantially frusto-conical.

3. The closure of claim 1 wherein the first sealing portion is contiguous with the top portion and projects downwardly from an underside of the top portion.

4. The closure of claim 1 wherein the second portion is substantially frusto-conical for at least a portion of its length.

5. The closure of claim 4 wherein the second sealing portion is molded at an angle of between about 25° and 75° relative to a notional plane extending at a right angle to the skirt portion of the closure.

6. The closure of claim 1 wherein the underside of the top portion of the closure has a nub extending downwardly from the underside of the top portion and positioned radially inwardly of the inner surface of the first sealing portion of the closure, said nub being positioned such that, during relative attachment of the closure with the end portion of the container, the nub contacts the inner surface of the end portion of the container.

7. The closure of claim 6 wherein the nub comprises a continuous member having an inner surface, an outer surface, and which extends downwardly and outwardly from the top portion to an end distal the top portion.

8. The closure of claim 7 wherein the outer surface of the nub has a contact surface that extends upwardly from the distal end of the nub for a portion of the outer surface and which contacts the inner surface of the container end portion on relative attachment of the closure to the container end portion.

9. A closure suitable for attachment to a container having an end portion defining an opening of the container, the closure comprising:

a top portion;

a skirt portion depending from the top portion, said top portion and skirt portion defining a cavity;

a first sealing portion comprising a thickening of the skirt portion that is also contiguous with an underside of the closure top portion and having an inner surface, said inner surface having a first substantially cylindrical surface portion that is substantially parallel (in cross-section) to and lying radially inwardly of the skirt portion and at least one second substantially cylindrical surface portion lying radially inwardly of and parallel (in cross-section) with the first surface portion, said second substantially cylindrical surface portion being spaced from the top portion by the first substantially cylindrical surface portion; and a second sealing portion separated from the top portion by the inner surface of the first sealing portion, and having an inner surface and an outer surface with the inner surface tangential to an innermost second substantially cylindrical surface portion of said one or more second substantially cylindrical surface portions;

wherein said second sealing portion, prior to attachment of the closure to the container, extends at least inwardly into said cavity to a free edge positioned inwardly of the skirt portion, and after attachment of the closure to the container, has been pushed relatively upwardly so that inner surface of said second sealing portion is brought into contact with at least the innermost of said second substantially cylindrical surface portions.

10. A closure suitable for attachment to a container having an end portion defining an opening of the container, the closure comprising:

a top portion;

a skirt portion depending from the top portion, said top portion and skirt portion defining a cavity;

a sealing rib having:

a first sealing portion which is at least adjacent the top portion and having an inner surface, said inner surface having a first substantially cylindrical surface portion that is substantially parallel (in cross-section) to and lying radially inwardly of the skirt portion and one or more second substantially cylindrical surface portions lying radially inwardly of and parallel (in cross-section) with the first surface portion, said second substantially cylindrical surface portion being spaced from the top portion by the first substantially cylindrical surface portion; and a second sealing portion, separated from the top portion by the inner surface of the first sealing portion and having an inner surface and an outer surface with the inner surface tangential to an innermost second substantially cylindrical surface portion of said one or more second substantially cylindrical surface portions, said second sealing portion, prior to attachment of the closure to the container, extending at least inwardly into said cavity to a free edge; and a continuous nub member extending downwardly and outwardly from the underside of the top portion and positioned radially inwardly of the first sealing portion;

the nub member having an inner frusto-conical surface extending downwardly from said underside of the top portion, an outer frusto-conical surface relatively shorter than said inner frusto-conical surface and also extending downwardly from said underside of the top portion, and an end surface distal the top portion and extending between said inner and outer frusto-conical surface;

wherein on relative attachment of the closure to the container end portion, the nub member seals with an inner surface of the container end portion and the sealing rib seals with at least an outer surface of the container end portion with the second sealing portion having been pushed relatively upwardly so that said inner surface of said second sealing portion in is brought into contact with at least said innermost second substantially cylindrical surface portion.

11. A container having an end portion defining an opening of the container, the end portion being sealed by a closure as defined in claim 1, 9 or 10.

12. A mold for forming a closure as defined in claim 1 wherein the mold has a cavity defining the features of the closure.

13. A mold for forming a closure as defined in claim 12 wherein the mold has a cavity defining the features of the closure.

14. A method of applying a closure as defined in claim 1, 12 or 10 to an end portion of a container, the method comprising a step of turning said closure onto the end portion of the container until the closure seals the container.

* * * * *